US006149216A

United States Patent [19]

Allcott

[11] Patent Number: 6,149,216

[45] Date of Patent: Nov. 21, 2000

[54] APPARATUS FOR INSTALLING STRUCTURAL FRAME MEMBERS

[76] Inventor: Kevin Allcott, 606 E. Pheasant Way, Bountiful, Utah 84010-4337

[21] Appl. No.: 09/045,602

[22] Filed: Mar. 20, 1998

[51] Int. Cl.[7] ..... B66C 1/64

[52] U.S. Cl. ..... 294/81.61; 294/87.1

[58] Field of Search ..... 294/67.1, 67.3–67.33, 294/81.1, 81.2, 81.5–81.56, 81.6–81.62, 87.1, 88, 104; 52/122.1, 125.1–125.3, 749.1; 269/9, 25, 37, 40, 43, 45, 46, 901, 910; 414/10–12

[56] References Cited

U.S. PATENT DOCUMENTS

| | | | |
|---|---|---|---|
| 1,291,437 | 1/1919 | Desch | 294/87.1 X |
| 2,472,843 | 6/1949 | Muise | 294/81.55 X |
| 2,717,801 | 9/1955 | Neil | 294/67.1 X |
| 2,965,408 | 12/1960 | Edwards | 294/81.6 X |
| 3,208,789 | 9/1965 | Barry | 294/81.61 X |
| 3,220,760 | 11/1965 | Buchik et al. | 294/81.61 |
| 3,357,464 | 12/1967 | Vroman . | |
| 4,322,064 | 3/1982 | Jarvis . | |
| 4,397,492 | 8/1983 | Craig | 294/81.56 |
| 4,541,618 | 9/1985 | Bruno . | |
| 4,629,171 | 12/1986 | Judy et al. . | |
| 4,801,130 | 1/1989 | Montgomery . | |
| 5,037,151 | 8/1991 | Kameyama et al. | 294/81.61 X |
| 5,125,552 | 6/1992 | Medwed . | |
| 5,181,703 | 1/1993 | Gilstad et al. . | |
| 5,234,204 | 8/1993 | Hunt . | |

FOREIGN PATENT DOCUMENTS

| | | | |
|---|---|---|---|
| 214355 | 10/1984 | Germany | 294/81.61 |
| 7607131 | 1/1978 | Netherlands | 294/81.61 |

*Primary Examiner*—Johnny D. Cherry

*Attorney, Agent, or Firm*—Clayton, Howarth & Cannon, P.C.

[57] ABSTRACT

A framing apparatus. The apparatus includes a freely movable support frame for supporting simultaneously a plurality of building frame members in hanging suspension therefrom. Attachment devices are secured to an under-surface of the support frame for attaching building frame members to the support frame such that the frame members are caused to hang in suspension when the support frame is lifted upwardly a sufficient distance. Movement of the support frame from a first location to a second location causes corresponding movement of the plurality of building frame members. The building frame members are preferably attached in horizontal parallel positions. The support frame is then lifted upwardly, for example by a crane, and then lowered to a desired position upon a preexisting building frame. The building frame members can thereafter be attached to the building frame, after which the support frame and attachment devices are removed. A plurality of building frame members are thereby simultaneously placed upon a building frame with precise, predetermined lateral spacing therebetween.

24 Claims, 2 Drawing Sheets

APPARATUS FOR INSTALLING STRUCTURAL FRAME MEMBERS

BACKGROUND OF THE INVENTION

1. The Field of the Invention

The present invention relates generally to framing equipment for use in the construction of buildings. More particularly, it concerns a framing device for positioning and installing a plurality of building frame members simultaneously.

2. The Background Art

Conventional framing methods in the construction of buildings involve positioning and installation of individual building frame members, such as floor joists, roof trusses and the like. A floor joist is essentially a beam-type member for supporting the floor of a building, often having an I-shaped cross section such as the floor joist 16 shown in FIG. 2A. The floor joist 16 typically comprises a main web 18 with upper and lower flanges 20. The floor of a building typically has a number of floor joists 16 extending beneath the floor for structural support.

During the framing portion of the building construction, the floor joists 16 are usually placed horizontally one by one, by hand at the desired lateral spacing. When the floor joists 16 are properly positioned and fastened to the building frame 17 as in FIG. 2B, the floor (not shown) is then constructed on top of the joists 16. The joists 16 essentially function as beams.

It will be appreciated that conventional framing methods are quite laborious and repetitive. As indicated in FIG. 2B, two or more individual workers 19 must place each joist 16 by hand which is very time-consuming and costly. The workers 19 often utilize a ladder 21 in order to place the joists 16 when framing an upper-level floor. The framing of upper-level floors, in addition to requiring the laborious and time-consuming hand placement and attachment methods, also requires workers 19 to remain upon a narrow ledge 23 of the building frame 17 for dangerously long periods of time. The ledge 23 is often only four-six inches wide. In order to be cost competitive, many companies often have their workers 19 remain atop the narrow ledge 23, while other workers 19 remain below to hoist the joists 16 up onto the ledge 23 where the workers remaining on the ledge take over to position and attach the joists 16.

This increased time of exposure of workers 19 upon the narrow ledge 23 is not only dangerous but potentially life threatening in the event of dizziness or other disorientation which could cause workers to fall from the narrow ledge 23. Since the major portion of the construction season spans the summer, workers are often exposed to hot and humid working conditions which increases the risk of fatigue or dizziness, and thus further increases the danger to workers who must remain atop the narrow ledge 23 in accordance with conventional framing methods.

Some attempts have been made to simplify the positioning and installation of building frame members. For example, U.S. Pat. No. 4,322,064 (granted Mar. 30, 1982 to Jarvis) discloses a spacing tool 10. The tool 10 is capable of repeatedly and precisely spacing building frame members such as roof trusses during framing procedures. However, even if the spacing tool were to be applied to the positioning and installation of floor joists, the laborious and time-consuming requirement of placing the joists one by one by hand remains, as well as the requirement of workers who must remain atop narrow ledges in order to be cost competitive. As such, the Jarvis patent fails to solve the problems inherent in the conventional methods of framing, including those discussed above.

OBJECTS AND SUMMARY OF THE INVENTION

It is an object of the present invention to provide a framing apparatus capable of positioning and precisely spacing a plurality of building frame members simultaneously.

It is a further object of the invention to provide such a framing apparatus which significantly reduces the exposure time which construction workers are required to spend atop narrow ledges while framing an upper-level floor.

It is an another object of the invention to provide such a framing apparatus which is simple in design and manufacture.

It is an additional object of the invention, in accordance with one aspect thereof, to provide such a framing apparatus capable of utilizing pneumatic pressure in positioning and spacing a plurality of building frame members.

The above objects and others not specifically recited are realized in a specific illustrative embodiment of a framing apparatus. The apparatus includes a freely movable support frame for supporting simultaneously a plurality of building frame members in hanging suspension therefrom. Attachment devices are secured to an under-surface of the support frame for attaching building frame members to the support frame such that the frame members are caused to hang in suspension when the support frame is lifted upwardly a sufficient distance.

Movement of the support frame from a first location to a second location causes corresponding movement of the plurality of building frame members. The building frame members are preferably attached in horizontal parallel positions. The support frame is then lifted upwardly, for example by a crane, and then lowered to a desired position upon a preexisting building frame. The building frame members can thereafter be attached to the building frame, after which the support frame and attachment devices are removed. A plurality of building frame members are thereby simultaneously placed upon a building frame with precise, predetermined lateral spacing therebetween.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
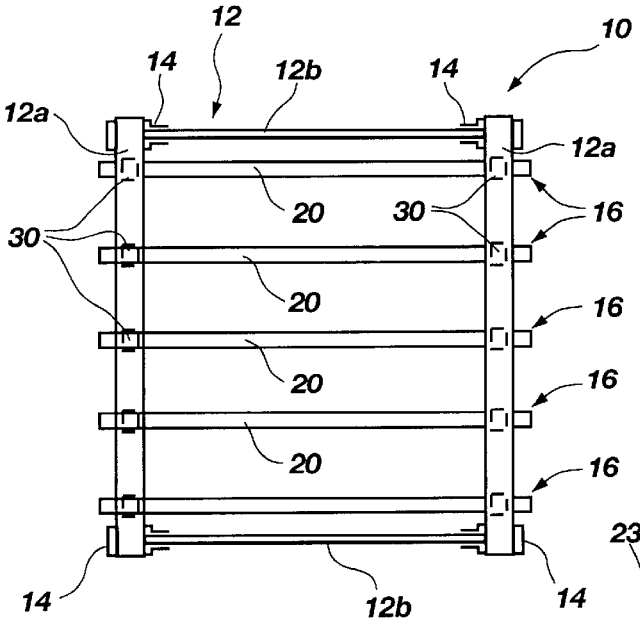
FIG. 1 is a plan view of a framing apparatus, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicant has discovered that a simple and effective framing apparatus can be constructed which greatly simplifies framing procedures in the construction of buildings, and reduces the dangers and risks required of construction workers. It is contemplated that applicant's invention is broadly applicable to the positioning and installation of any building frame member, including floor joists, roof trusses and the like.

Referring now to FIG. 1, there is shown a framing apparatus, designated generally at 10. The apparatus 10 includes a frame 12 comprised of first frame arms 12*a* and second frame arms 12*b* interconnected to form a four-sided frame. The frame arms 12*a* and 12*b* are preferably clamped together by a suitable corner connecting member 14 to form a rectangle. The word "rectangle" as used herein shall be construed broadly to include squares as well as non-square rectangles.

One of the key principles of the present invention is that a plurality of building frame members such as floor joists 16 can be secured beneath the frame 12 in any desired pre-spaced configuration. The joists 16 are attached to the frame 12 by clamping members 30 at the desired spacing so that the joists 16 hang in suspension beneath the support frame 12 when the frame is lifted upwardly a sufficient distance. As such, the support frame 12 operates as a freely movable support means for supporting simultaneously a plurality of the joists 16 in hanging suspension therefrom.

A crane (not shown) or other suitable lifting device is coupled to the frame 12 to lift and move the frame 12 from a first location to a second location, thereby causing corresponding movement of the plurality of joists 16 hanging in suspension from the frame 12.

It will be appreciated from the description above that framing procedures are greatly simplified with the present invention. Workers may attach the frame 12 to a crane (not shown) so as to position the frame 12 initially at stomach- or chest-level. With the frame 12 hanging in such an initial position, the workers (such as workers 19 shown in FIG. 2B) can quickly attach a plurality of the joists 16 to the clamping members 30. The clamping members 30 can of course be spaced in any configuration, and it is typical that building frame members are placed parallel to one another with uniform lateral spacing therebetween.

Figure 2A:
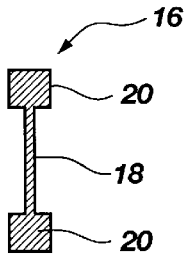
FIG. 2A is a frontal, cross-sectional view of a conventional floor joist.

After the joists 16 have been quickly attached, the crane (not shown) simply lifts the frame 12 and the attached joists 16 onto a desired location of a preexisting building frame, after which workers may mount the building frame in order to quickly attach the joists 16 which remain in their precise, pre-spaced configuration because of the clamping members 30. The framing device 10 essentially positions and precisely spaces the building frame members (joists 16 in FIGS. 1–2 and 4) instead of the workers performing these tasks. All that is required of the workers is to carefully guide the framing device 10 to a desired location so that the joists 16 are positioned where desired. The workers can then quickly attach the joists 16 with nail guns (not shown) or any other suitable installation device.

Figure 2B:
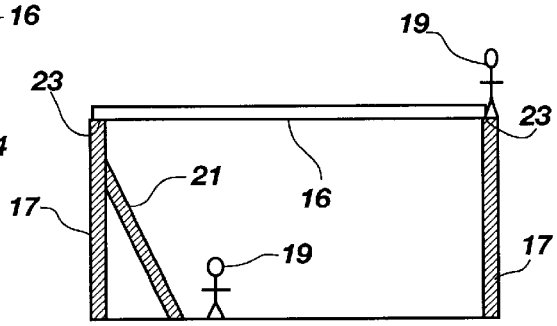
FIG. 2B is a side, cross-sectional view of a typical building frame whereon an upper-level floor is to be constructed.

Therefore, workers need only reside atop the narrow ledge 23 shown in FIG. 2B during the installation phase and only briefly during the positioning and spacing phase if at all, depending upon the situation. This decreases significantly the amount of time a worker must spend atop the narrow ledge 23. In addition, since the joists 16 are placed simultaneously, there is always a framework of joists spanning the ledges 23 after initial placement, so that the framework of joists 16 may operate as a safety catching structure if a worker 19 does fall.

Figure 4:
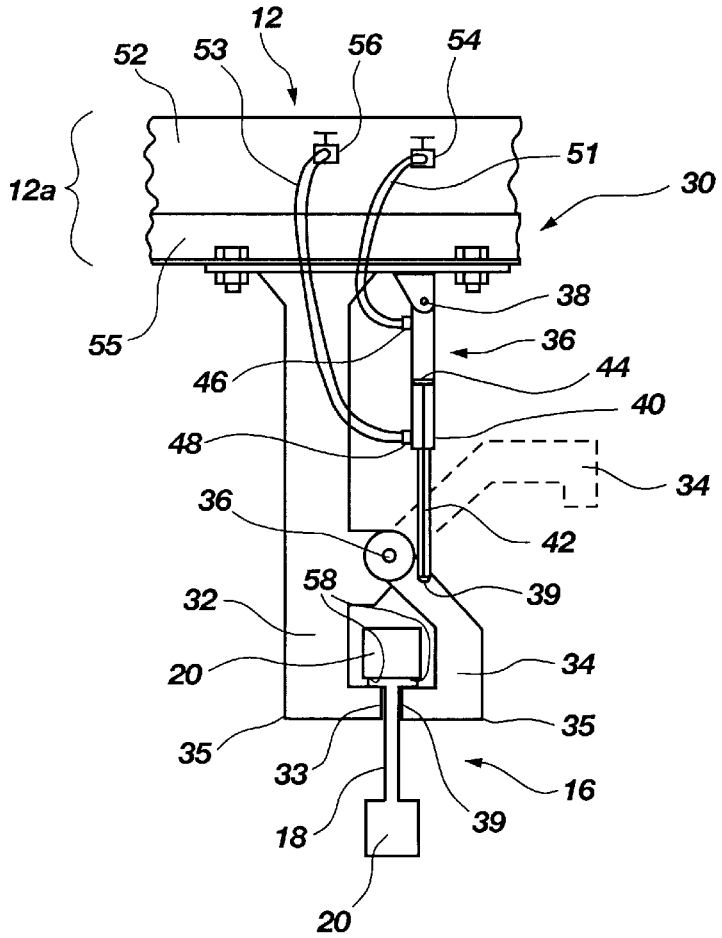
FIG. 4 is an enlarged break-away view of a portion of the framing apparatus of FIG. 1, with a detailed view of clamping jaws made in accordance with the principles of the present invention.

Referring now to FIGS. 1 and 4, the clamping members 30 operate as attachment means for attaching the joists 16 to the support frame 12. The clamping member 30 includes a first jaw member 32 disposed in a substantially stationary orientation relative to the support frame 12, and a second jaw member 34 pivotally attached to the first jaw member 32. A pneumatic cylinder 36 is coupled at first and second ends thereof to pivot points 38 and 39 on the support frame 12 and the second jaw member 34, respectively. The pneumatic cylinder 36 includes a cylinder body 40 and a reciprocating piston 42 slidably disposed within the body 40. The piston 42 has a piston head 44 disposed within the cylinder body 40. First and second ports 46 and 48 are formed in the cylinder body 40 on opposing sides of the piston head 44.

At least a portion of the support frame 12 includes compressed gas 50 contained therein. Preferably, the first frame arms 12*a* comprise co-extensive hollow and solid bars 52 and 55, respectively, secured together along their lengths, with the compressed gas 50 stored within the hollow bar 52. The clamping member 30 is pneumatically actuated, and includes actuation means responsive to fluidic communication with the compressed gas 50 contained in the hollow bar 52 of the support frame 12 for attaching the plurality of joists 16 to the support frame 12. The actuation means is operable to selectively expose the piston head 44 of the clamping member 30 to fluidic communication with the compressed gas 50. The actuation means preferably comprises first and second conduits 51 and 53 and associated valves 54 and 56, respectively.

The conduits 51 and 53 are coupled to the first and second ports 46 and 48, respectively, and to the hollow bar 52 for placing the ports in fluidic communication with the compressed gas 50. The valves 54 and 56 are selectively operable for blocking and releasing fluid flow within said conduits 51 and 53. Preferably, the actuation means in the form of conduits 51 and 53 and associated valves 54 and 56 is operable for actuating the pneumatic cylinder 36 to thereby pivot the second jaw member 34 toward and away from the first jaw member 32 into open and closed positions, respectively, as shown in FIG. 4 by the phantom-line depiction of the second jaw member 34 in an open position.

It will be appreciated that when fluid pressure is applied through the second conduit 53 to force the piston head 44 upwardly, the cylinder 36 pneumatically contracts to thereby pivot the second jaw member 34 away from the first jaw member 32 to an open position. Conversely, when fluid pressure is applied through the first conduit 51 to force the piston head 44 downwardly, the cylinder 36 pneumatically expands to thereby pivot the second jaw member 34 toward the first jaw member 32 to a closed position.

As shown most clearly in FIG. 4, clamping member 30 constitutes a holding means for substantially surrounding one of the segments of a building frame member (joist 16) and holding the building frame member in hanging suspension under force of gravity. In this case the segment which is substantially surrounded by the clamping member 30 is flange 20 of the joist 16. The first and second jaw members 32 and 34 each preferably terminate in a hook shape defining a substantially ninety-degree angle 35 as shown, such that opposing end faces 33 and 39 are maintained substantially parallel to the flat opposing sides of the web 18, in abutting contact therewith. The phrase "hook shape" shall be construed broadly to include the L-shapes of jaw members 32 and 34, curved shapes, or any other hook shape useable to clamp upon opposing sides of the flange 18. The hook-shaped jaw members 32 and 34 thus need not define a straight right-angle, but may generally traverse ninety degrees in any straight or curvilinear manner. The concept of the jaw members 32 and 34 "terminating in a hook shape defining a substantially ninety-degree angle" is thus to be construed broadly to cover any structure which extends around a generally ninety-degree angle, regardless of whether any actual angle defined by the hook shape is slightly more or less than ninety degrees, since that the jaw members 32 and 34 extend vertically downwardly and then lateral toward opposing flat sides of the web 18. The right-angle terminus of the jaw members 32 and 34 provides horizontal contacting faces 58 between the end faces 33 and 39 of the jaw members 32 and 34 and the flanges 20 of the joists 16.

In use, the second jaw members 34 of each clamping member 30 are raised to their open positions. The joists 16 are placed between the jaw members 32 and 34 after which said jaw members 32 and 34 may be manually closed into position around the flange 20. The valve 54 is then manipulated to cause downward pneumatic pressure upon the piston head 44 to lock the second jaw member 34 into the closed position around the flange 20 of the joist 16. The frame 12 is lifted by a crane (not shown) or other suitable lifting device and carried to a desired location so as to position the joists 16 upon a building frame such as the frame 17 in FIG. 2B. The joists 16 are nailed or otherwise suitably attached to the building frame, after which the second jaw members 34 are again opened. A worker can then gently push the framing device 10 to the side to dislodge the first jaw members 32 laterally away from the joists 16. The framing device 10 is then lifted upwardly and carried away for reloading or storage.

The jaw members 32 and 34 thus operate as jaw means for substantially surrounding one of the flange members 20 while pinching opposing faces of the web member 18 and engaging in abutting contact with an underside contacting face 58 of the flange member 20 to thereby hold the joist 16 in hanging suspension.

It will be appreciated that fluid pressure within the hollow bar 52 may be conserved by utilizing only a minimal amount of the pressurized fluid 50 for opening the second jaw member 34. It will usually, if not always, be preferred to open the second jaw member 34 when there is little or no contact pressure between the jaw member 34 and the flange 20, i.e. after pressure is released by lowering the support frame 12 when positioning the joists 16. Therefore, valve 56 preferably comprises a pressure-reducing valve for releasing compressed gas from the hollow bar 52 into the cylinder body 40 at a pressure which is substantially lower than fluid pressure within the hollow bar 52.

Since the valve 56 might be actuated inadvertently while the joists 16 are hanging in suspension from the frame 12, or even during transport of the joists, the pressure-reducing nature of the valve 56 is also a safety enhancement. In order to prevent accidental contact with valve 56 from causing the second jaw member 34 to open during transport of the joists 16, the pressure-reducing valve 56 is preferably calibrated to release compressed fluid from the hollow bar 52 at a pressure less than twenty-five pounds per square inch ("psi"). The weight of the joists 16, which engages with the second jaw member 34 in static friction at the contacting face 58 to produce pressure substantially greater than twenty-five psi, prevents the second jaw member 34 from opening in the event the valve 56 is accidently actuated while the joists 16 are hanging in suspension from the clamping members 30.

Of course, any alternative source of compressed gas or other means for actuating the cylinder 36 is also in accordance with the principles of the present invention. For example, instead of storing compressed gas 50 within the upper-hollow bar 52, any other suitable supply of compressed gas could be used, and any other pneumatic actuation apparatus or method could be used to operate any suitable clamping device for clamping building frame members to a support means in order to accomplish the purposes of the present invention. Those having ordinary skill in the relevant art will appreciate numerous alternative structural combinations suggested by the present disclosure which may achieve the stated objects and purposes of the present invention.

Figure 4A:
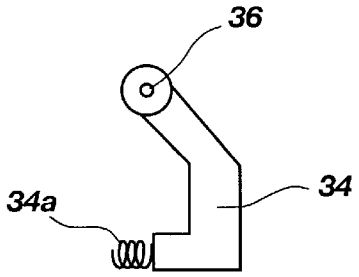
FIG. 4A is a side, partial view of an alternative embodiment of the clamping jaws of FIG. 4.

Preferably, the distal ends of the jaw members 32 and 34 will be locked into contact with the opposing sides of the web 18 as shown in FIG. 4. Since there are different thicknesses of the web 18 and various joists 16 available in the field, it is advantageous to design the clamping member 30 such that a relatively wider space resides between the distal ends of the jaw members 32 and 34 when the clamping member 30 is in a close position. It will be understood by those having ordinary skill in the art that such a wider space will enable the clamping member 30 to be used with a wide range of thicknesses of the web 18, and that a spring member 34*a* as shown in FIG. 4A can be placed upon the distal end of jaw member 34 as shown to ensure that the web 18 is always pinched between the opposing jaw members 32 and 34, regardless of the width of the web 18.

Figure 3:
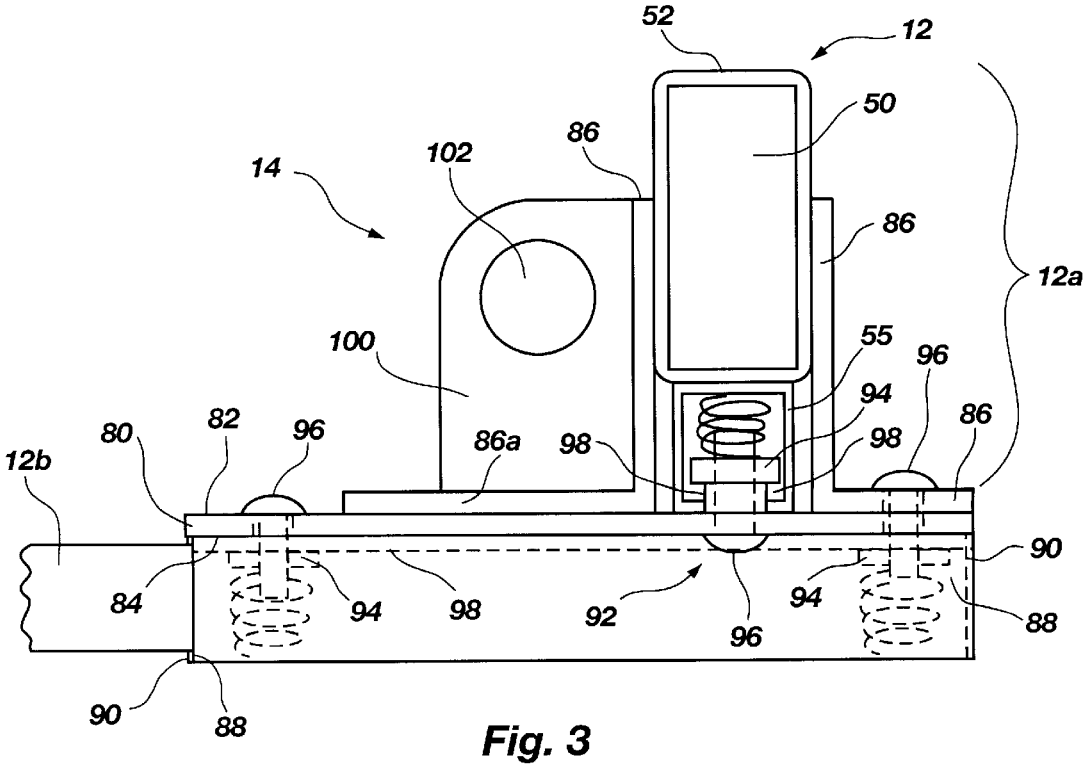
FIG. 3 is a side view of a corner connector of the framing apparatus of FIG. 1, made in accordance with the principles of the present invention.

Referring now to FIG. 3, an enlarged, detailed side view of the corner connecting member 14 is illustrated. The corner connecting member 14 comprises a support plate 80 having upper and lower opposing surfaces 82 and 84, respectively. First and second opposing channel walls 86 extend outwardly from the upper surface 82 of the support plate 80 to form an upper channel configured and dimensioned for receiving a first frame arm 12*a* therein. Third and fourth opposing channel walls 88 and 90 extend outwardly from the lower surface 84 of the support plate 80 to form a lower channel configured and dimensioned for receiving a second frame arm 12*b* therein, orthogonally positioned relative to the first frame arm 12*a*.

Securing means 92 are provided for releasably securing the first and second frame arms 12*a* and 12*b* within the upper and lower channels formed by the walls 86 and 88, respectively. The securing means 92 comprises a spring-loaded nut 94 and a bolt 96. Solid bar 55 of the first frame arm 12*a*, and the second frame arm 12*b*, are preferably identical solid bars, and are themselves configured in the form of channels, such as UNISTRUT™ as presently known in the industry. The solid bar 55 and second frame arm 12*b* terminate in inner channel edges 98 (shown in FIG. 3). A spring-loaded nut 94 can be placed therein to abut the edges 98, with the spring portion maintaining the nut portion in abutting contact against the edges 98, so that the bolt 96 may be screwed into the nut.

The upper and lower channels formed by the walls 86 and 88, respectively, are disposed in a substantial right-angle orientation with respect to one another such that first and second frame arms 12*a* and 12*b* are respectively disposed therein to form a right-angle corner and such that the four frame arms define four sides of a rectangle, depicted most clearly in FIGS. 1 and 3. The corner connecting member 14 further comprises a support web 100 fixedly attached to the upper channel walls 86 and to the support plate 80. It is noted that the walls 86 may include base portions 86*a* to which the web 100 is directly attached. In such embodiments, even though the web 100 is not in direct contact with the support plate 80, it is still fixedly attached thereto since the base portions 86*a* are fixedly secured to the web 100 and the support plate 80. The support web 100 has a hole 102 formed therein to enable a cable means (not shown) to pass therethrough for carrying the corner connecting member 14 and attached support frame 12 from a first location to a second location.

In accordance with the disclosure set forth above, a preferred method for positioning and installing building frame members as part of a framing procedure in the construction of a building comprises the steps of:

(a) securing a plurality of building frame members to a freely moveable support means for supporting said frame members simultaneously in a predetermined arrangement with respect to one another;

(b) selectively moving the support means from a first location to a second location so as to selectively and simultaneously place the plurality of building frame members in respective desired locations against a portion of a frame for a building while said frame members remain disposed in their predetermined arrangement with respect to one another;

(c) attaching the building frame members to said portion of a frame for a building; and (d) removing the support means from the building frame members.

Figure 5:
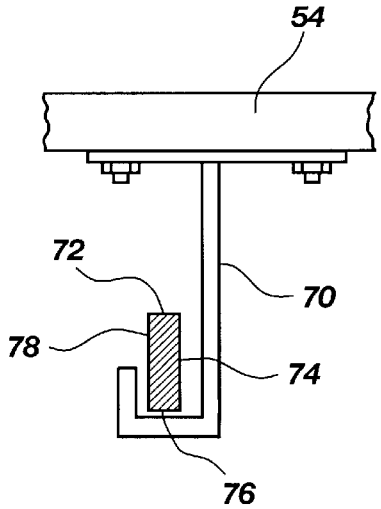
FIG. 5 is an alternative embodiment of the clamping jaws of FIG. 4, in the form of a hook member.

It is to be understood that the above-described arrangements are only illustrative of the application of the principles of the present invention. Numerous modifications and alternative arrangements may be devised by those skilled in the art without departing from the spirit and scope of the present invention. For example, the holding means may alternatively comprise a plurality of hooks 70 as shown in FIG. 5. In applications involving positioning of roof trusses, the hooks 70 are advantageously configured and dimensioned for hooking segments 72 of such trusses to thereby carry said trusses. As such, the hook 70 substantially surrounds the segment 72 and holds the building frame member (of which the segment 72 is a part) in hanging suspension under force of gravity.

The phrase "substantially surround" as used herein shall refer broadly to any surrounding action of a first object around a second object where at least fifty percent of the second object's width/perimeter is surrounded thereby. As shown in FIG. 5, all of sides 74 and 76, and part of side 78, which is more than half of the width/perimeter of the segment 72, are surrounded by the hook 70. Similarly, the first and second jaw members 32 and 34 of FIG. 4 surround all four sides of the flange 20, except for the portion of the flange 20 which is connected to the web 18. As such, the phrase "substantially surround" also applies to FIG. 4.

What is claimed is:

1. An apparatus for use in positioning and installing building frame members as part of a framing procedure in the construction of a building, said apparatus comprising:

freely moveable support means for supporting simultaneously a plurality of building frame members; and attachment means for attaching the plurality of building frame members to the support means such that said building frame members are held beneath said support means when said support means is lifted upwardly, and such that movement of the support means from a first location to a second location causes corresponding movement of the plurality of building frame members, wherein the attachment means further comprises at least one rigid member stationarily attached to the support means such that said rigid member remains in a fixed position with respect to the support means, and at least one moveable law member that is moveable toward and away from at least a portion of said rigid member for releasably holding a building frame member between said rigid member and said moveable jaw member such that said building frame member is held stationary in a lateral dimension relative to the support means.

2. The apparatus as defined in claim 1, for use in positioning and installing building frame members comprised of multiple segments, wherein the rigid member and the moveable jaw member of the attachment means collectively comprise holding means for substantially surrounding one of the segments of a building frame member and holding said building frame member in hanging suspension under force of gravity.

3. The apparatus as defined in claim 2 for use in positioning and installing building frame members comprising a main web having opposing faces bounded by opposing edges and flange members coupled to said opposing edges of the web such that the building frame members form an I-shaped cross-section, wherein the holding means comprises means for substantially surrounding one of the flange members of the I-shaped building frame member and holding said building frame member in hanging suspension under force of gravity.

4. The apparatus as defined in claim 3, wherein the holding means further comprises jaw means for substantially surrounding said one of the flange members while pinching the opposing faces of the web member and engaging in abutting contact with an underside of the flange member to thereby hold the building frame member in hanging suspension.

5. The apparatus as defined in claim 2, wherein the holding means comprises a plurality of hooks configured and dimensioned for hooking segments of the building frame members to thereby carry said building frame members.

6. The apparatus as defined in claim 1, wherein the attachment means includes means for attaching the plurality of building frame members to the support means in a predetermined, spaced-apart relationship, such that movement of the support means causes corresponding movement of said building frame members while in their predetermined, spaced-apart relationship.

7. The apparatus as defined in claim 1, wherein the attachment means comprises pneumatically-actuated attachment means for utilizing pneumatic pressure to attach the plurality of building frame members to the support means.

8. The apparatus as defined in claim 7, wherein at least a portion of the support means includes compressed gas contained therein, and wherein the pneumatically-actuated attachment means comprises means responsive to fluidic communication with the compressed gas contained in the support means for attaching the plurality of building frame members to the support means, the apparatus further comprising:

actuation means for selectively exposing the attachment means to fluidic communication with the compressed gas contained in the support means.

9. The apparatus as defined in claim 8, said pneumatically-actuated attachment means comprising a plurality of hydraulic pistons each comprising a cylinder and a reciprocating piston head disposed within said cylinder, said cylinder having first and second ports formed therein on opposing sides of the piston head, the actuation means comprising:

first and second conduit means coupled to the first and second ports, respectively, for placing said ports in fluidic communication with the compressed gas contained in the support means; and selectively operable valve means disposed in fluidic communication with the first and second conduit means for blocking and releasing fluid flow within said conduit means.

10. The apparatus as defined in claim 7, wherein the attachment means comprises a plurality of pneumatically-actuated clamping members coupled to the support means, each clamping member comprising:

a first jaw member disposed in a substantially stationary orientation relative to the support means;

a second jaw member pivotally attached to the first jaw member;

a pneumatic cylinder having first and second ends coupled to the support means and the second jaw member; and actuation means for actuating the pneumatic cylinder to thereby pivot the second jaw member toward and away from the first jaw member into open and closed positions, respectively.

11. The apparatus as defined in claim 10, wherein the actuation means further comprises means for (i) pneumatically contracting the cylinder to thereby pivot the second jaw member away from the first jaw member to an open position, and (ii) pneumatically expanding the cylinder to thereby pivot the second jaw member toward the first jaw member to a closed position.

12. The apparatus as defined in claim 11, wherein the first and second jaw members each terminate in a hook shape defining a substantially ninety-degree angle.

13. The apparatus as defined in claim 1, wherein the support means comprises a freely moveable support frame having four frame arms releasably attached to each other so as to form four sides of the support frame.

14. The apparatus as defined in claim 13, wherein the frame arms include intersecting opposing ends forming four corners, the support frame further comprising corner connecting means for fixedly and releasably securing the intersecting opposing ends of the frame arms to each other.

15. An apparatus for use in positioning and installing building frame members as part of a framing procedure in the construction of a building, said apparatus comprising:

freely moveable support means for supporting simultaneously a plurality of building frame members in hanging suspension therefrom;

attachment means for attaching the plurality of building frame members to the support means such that said building frame members are caused to hang in suspension beneath said support means when said support means is lifted upwardly a sufficient distance, and such that movement of the support means from a first location to a second location causes corresponding movement of the plurality of building frame members;

wherein the support means comprises a freely moveable support frame having four frame arms releasably attached to each other so as to form four sides of the support frame;

wherein the frame arms include intersecting opposing ends forming four corners, the support frame further comprising corner connecting means for fixedly and releasably securing the intersecting opposing ends of the frame arms to each other;

wherein the corner connecting means comprises:

a support plate having upper and lower opposing surfaces;

first and second opposing channel walls extending outwardly from the upper surface of the support plate to form an upper channel configured and dimensioned for receiving a frame arm therein;

third and fourth opposing channel walls extending outwardly from the lower surface of the support plate to form a lower channel configured and dimensioned for receiving a frame arm therein; and securing means for releasably securing two of the frame arms within the upper and lower channels, respectively.

16. The apparatus as defined in claim 15, wherein the upper and lower channels are disposed in a substantial right-angle orientation with respect to one another such that first and second frame arms respectively disposed therein form a right-angle corner and such that the four frame arms define four sides of a rectangle.

17. The apparatus as defined in claim 15, wherein the corner connecting means further comprises a support web fixedly attached to the upper channel and the support plate, said support web having a hole formed therein to enable a cable means to pass therethrough for carrying the corner connecting means and attached support frame from a first location to a second location.

18. An apparatus for positioning and installing building frame members as part of a framing procedure in the construction of a building, said apparatus comprising:

freely moveable support means including load-bearing members for supporting simultaneously a plurality of building frame members, at least one of said load-bearing members having compressed gas contained therein;

pneumatically-actuated attachment means responsive to fluidic communication with the compressed gas contained in the at least one load-bearing member of the support means for attaching the plurality of building frame members to the support means such that said building frame members are held thereby beneath said support means, and such that movement of the support means from a first location to a second location causes corresponding movement of the plurality of building frame members; and actuation means for selectively exposing the attachment means to fluidic communication with the compressed gas contained in the at least one load-bearing member of the support means.

19. The apparatus as defined in claim 18, said attachment means comprising a plurality of hydraulic pistons, each comprising a cylinder and a reciprocating piston head disposed within said cylinder, said cylinder having first and second ports formed therein on opposing sides of the piston head, the actuation means comprising:

first and second conduit means coupled to the first and second ports, respectively, for placing said ports in fluidic communication with the compressed gas contained in the at least one load-bearing member of the support means; and selectively operable valve means disposed in fluidic communication with the first and second conduit means for blocking and releasing fluid flow within said conduit means.

20. An apparatus for positioning and installing building frame members as part of a framing procedure in the construction of a building, said apparatus comprising:

freely moveable support means for supporting simultaneously a plurality of building frame members, at least a portion of said support means having compressed gas contained therein;

Pneumatically-actuated attachment means responsive to fluidic communication with the compressed gas contained in the support means for attaching the plurality of building frame members to the support means such that said building frame members are held thereby beneath said support means, and such that movement of the support means from a first location to a second location causes corresponding movement of the plurality of building frame members; and actuation means for selectively exposing the attachment means to fluidic communication with the compressed gas contained in the support means;

said attachment means comprising a plurality of hydraulic pistons each comprising a cylinder and a reciprocating piston head disposed within said cylinder, said cylinder having first and second ports formed therein on opposing sides of the piston head, the actuation means comprising:

first and second conduit means coupled to the first and second ports, respectively, for placing said ports in fluidic communication with the compressed gas contained in the support means; and selectively operable valve means disposed in fluidic communication with the first and second conduit members for blocking and releasing fluid flow within said conduit members;

wherein the valve means comprises a pressure-reducing valve disposed in fluidic communication with the second conduit means for releasing compressed gas from the support means into the cylinder at a pressure which is substantially lower than gas pressure within the support means.

21. The apparatus as defined in claim 20, wherein the pressure-reducing valve is calibrated to release compressed gas from the support means at a pressure less than twenty-five psi.

22. An apparatus for use in positioning and installing building frame members as part of a framing procedure in the construction of a building, said apparatus comprising:

a freely moveable support frame having four frame arms releasably attached to each other so as to form four sides of the support frame; and attachment means for attaching the plurality of building frame members to the support frame such that said building frame members are caused to hang in suspension beneath said support frame when said support frame is lifted upwardly a sufficient distance, and such that movement of the support frame from a first location to a second location causes corresponding movement of the plurality of building frame members;

wherein the frame arms include intersecting opposing ends forming four corners, the support frame further comprising corner connecting means for fixedly and releasably securing the intersecting opposing ends of the frame arms to each other wherein the corner connecting means comprises:

a support plate having upper and lower opposing surfaces;

first and second opposing channel walls extending outwardly from the upper surface of the support plate to form an upper channel configured and dimensioned for receiving a frame arm therein;

third and fourth opposing channel walls extending outwardly from the lower surface of the support plate to form a lower channel configured and dimensioned for receiving a frame arm therein; and securing means for releasably securing two of the frame arms within the upper and lower channels, respectively.

23. The apparatus as defined in claim 22, wherein the upper and lower channels are disposed in a substantial right-angle orientation with respect to one another such that first and second frame arms respectively disposed therein form a right-angle corner and such that the four frame arms define four sides of a rectangle.

24. The apparatus as defined in claim 22, wherein the corner connecting means further comprises a support web fixedly attached to the upper channel and the support plate, said support web having a hole formed therein to enable a cable means to pass therethrough for carrying the corner connecting means and attached support frame from a first location to a second location.

* * * * *